US009985331B2

(12) United States Patent
Boutayeb

(10) Patent No.: US 9,985,331 B2
(45) Date of Patent: May 29, 2018

(54) SUBSTRATE INTEGRATED WAVEGUIDE SWITCH

(71) Applicant: Huawei Technologies Co., Ltd., Shenzhen (CN)

(72) Inventor: Halim Boutayeb, Montreal (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days. days.

(21) Appl. No.: 14/793,615

(22) Filed: Jul. 7, 2015

(65) Prior Publication Data

US 2017/0012335 A1 Jan. 12, 2017

(51) Int. Cl.
*H01P 1/10* (2006.01)
*H01P 3/12* (2006.01)
*H01P 1/15* (2006.01)

(52) U.S. Cl.
CPC ..... *H01P 3/121* (2013.01); *H01P 1/15* (2013.01)

(58) Field of Classification Search
CPC .. H01P 1/10; H01P 1/122; H01P 1/125; H01P 1/127
USPC ..... 333/101–105, 108
See application file for complete search history.

(56) References Cited

U.S. PATENT DOCUMENTS 5,116,807 A * 5/1992 Romanofsky ..... H01P 1/185 333/161
5,268,696 A * 12/1993 Buck ..... H01Q 13/085 200/181
6,373,349 B2 * 4/2002 Gilbert ..... H04B 1/52 333/126
6,452,465 B1 * 9/2002 Brown ..... H01P 1/20381 333/205
6,864,848 B2 * 3/2005 Sievenpiper ..... H01Q 9/14 343/767
7,271,683 B2 * 9/2007 Hayes ..... H01P 5/04 333/101
7,292,125 B2 * 11/2007 Mansour ..... H01P 1/125 333/108
8,648,676 B2 * 2/2014 Abhari ..... H01P 1/184 333/209

(Continued)

FOREIGN PATENT DOCUMENTS

CN 2796136 Y 7/2006
CN 2809911 Y 8/2006

(Continued)

OTHER PUBLICATIONS

Li-Yang et al., A Novel Compact Electromagnetic-Bandgap (EBG) Structure and Its Applications for Microwave Circuits, Jan. 2005, IEEE, vol. 53, No. 1, 8 pages.*

(Continued)

*Primary Examiner* — Dean Takaoka
(74) *Attorney, Agent, or Firm* — Slater Matsil, LLP

(57) ABSTRACT

A substrate integrated waveguide switch and a method of operating the substrate integrated waveguide switch are disclosed. In an embodiment a system includes a dielectric substrate and a switch supported by the dielectric substrate, the switch comprising at least one first transmission path, at least one first switching element in each of the at least one first transmission path, a second transmission path, and at least one second switching element in the second transmission path.

27 Claims, 15 Drawing Sheets

(56) References Cited

U.S. PATENT DOCUMENTS 8,754,722 B2 * 6/2014 Choi ..... H01P 1/127
333/104

FOREIGN PATENT DOCUMENTS

| | | | |
|---|---|---|---|
| CN | 101702460 | A | 5/2010 |
| CN | 202259640 | U | 5/2012 |

OTHER PUBLICATIONS

Inseop Lim et al., Substrate Integrated Waveguide (SIW) Single Pole Double Throw (SPDT) Switch for X-Band Applications, Aug. 2014, IEEE Microwaves, vol. 24, No. 8, 3 pages.*

Yang Fei et al., Substrate Integrated Waveguide Switch Matrix in LTCC Technology, 2013, Asia-Pacific Microwave Conference Proceedings, P-32, 3 pages.*

Tuncay Erdol, X-Band RF Switch Implementation in Substrate Integrated Waveguide, Sep. 2012, Middle East Technical University, 108 pages.*

Li, Z. et al., "24-GHz Frequency-Modulation Continuous-Wave Radar Front-End System-on-Substrate", IEEE Transactions on Microwave Theory and Techniques, vol. 56, No. 2, Feb. 2008, pp. 278-285.

* cited by examiner

SUBSTRATE INTEGRATED WAVEGUIDE SWITCH

TECHNICAL FIELD

The present invention relates generally to a substrate integrated waveguide switch and method of operating the substrate integrated waveguide switch, and, in particular embodiments, to a substrate integrated waveguide switch for RF signals, microwave signals or millimeter wave signals and a method for operating such a switch for these signals.

BACKGROUND

Substrate Integrated Waveguides (SIWs) are integrated waveguide-like structures fabricated by using two rows of conducting cylinders or slots embedded in a dielectric substrate. These rows of conducting cylinders electrically connect two parallel metal plates. In this way, the non-planar rectangular waveguide can be made in planar form, compatible with existing planar processing techniques.

SUMMARY

In accordance with an embodiment of the present invention, a system comprises a dielectric substrate and a multi-throw switch supported by the dielectric substrate, the multi-throw switch comprising at least one first transmission path, at least one first switching element in each of the at least one first transmission path, a second transmission path, and at least one second switching element in the second transmission path, wherein the multi-throw switch is configured to direct propagation of an electromagnetic signal along the at least one first transmission path when the at least one first switching element passes the electromagnetic signal and the at least one second switching element blocks the electromagnetic signal, and wherein the multi-throw switch is configured to direct the propagation of the electromagnetic signal along the second transmission path when the at least one second switching element passes the electromagnetic signal and the at least one first switching element blocks the electromagnetic signal.

In accordance with an embodiment of the present invention, a system comprises a dielectric substrate comprising an upper surface and a lower surface, an upper conductive layer disposed at the upper surface, the upper conductive layer comprising transmission arms, a lower conductive layer disposed at the lower surface, and vertical conductive elements located at edges of the transmission arms of the upper conductive layer, the vertical conductive elements electrically connecting the upper conductive layer with the lower conductive layer. The system further comprises reconfigurable electromagnetic band gap (EBG) structures located at least at some transmission arms, the reconfigurable EBG structures configured to pass or block an electromagnetic signal through the respective transmission arms.

In accordance with an embodiment of the present invention, an arrangement a system comprising a dielectric substrate and a multi-throw switch supported by the dielectric substrate, the multi-throw switch. The multi-throw switch further comprises at least one first transmission path, at least one first switching element in each first transmission path, a second transmission path, and at least one second switching element in each second transmission path, wherein the multi-throw switch is configured to direct propagation of an electromagnetic signal along the at least one first transmission path when the at least one first switching element passes the electromagnetic signal and at least one second switching element blocks the electromagnetic signal, and wherein the multi-throw switch is configured to direct the propagation of the electromagnetic signal along the second transmission path when the at least one second switching element passes the electromagnetic signal and the at least one first switching element blocks the electromagnetic signal.

In accordance with an embodiment of the present invention, a system comprises a dielectric substrate and a single-throw switch supported by the dielectric substrate, wherein the single-throw switch includes a transmission path and at least one switching element in the transmission path, wherein the single-throw switch is configured to direct propagation of an electromagnetic signal along the transmission path when the at least one switching element passes the electromagnetic signal, and wherein the single-throw switch is configured to block the propagation of the electromagnetic signal along the transmission path when the at least one switching element blocks the electromagnetic signal.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

A problem with conventional RF switches is that they are bulky, need extra connectors and cables and have a high insertion loss.

Embodiments of the invention provide a system on substrate switch that switches electromagnetic signals by reconfigurable electromagnetic band gap (EBG) structures to different transmission paths of the switch. Further embodiments disclose that the reconfigurable EBG structures comprise EBGs and tunable elements such as PIN diodes and MEMS devices. The tunable elements may be part of the system on substrate. The tunable elements may apply a load to the EBGs thereby controlling the propagation of the electromagnetic signal.

Substrate integrated waveguide (SIW) structures exhibit propagation characteristics similar to the ones of classical rectangular waveguides, including the field pattern and the dispersion characteristics. Moreover, SIW structures preserve most of the advantages of conventional metallic waveguides, namely high quality-factor and high power-handling capability with self-consistent electrical shielding. The most significant advantage of SIW technology is the possibility to integrate all the components on the same substrate, including passive components, active elements and even antennas. Moreover, there is the possibility to mount one or more chip-sets on the same substrate. There is no need for transitions between elements fabricated with different technologies, thus reducing losses and parasitics. In this way, the concept can be extended to the system-on-substrate including waveguide elements and circuit elements. A system-on substrate represents the ideal platform for developing cost-effective, easy-to-fabricate and high performance microwave systems.

Figure 1A:
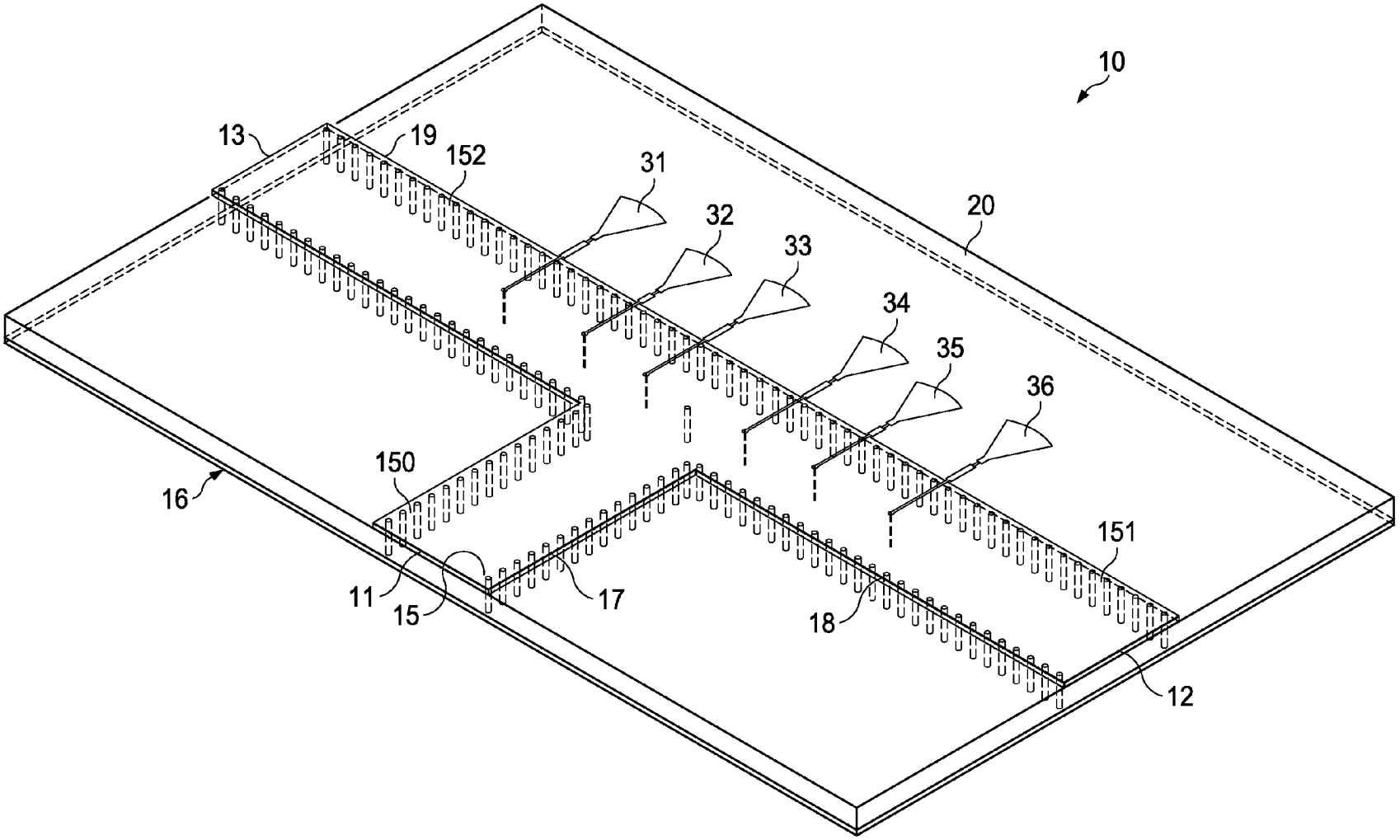
FIG. 1*a* is a 3D view of a double throw SIW switch (a special form of a multi-throw switch) according to an embodiment.

FIG. 1*a* shows an embodiment of a double throw substrate integrated waveguide (SIW) switch 10. The switch 10 has three ports 11, 12, 13; an input port 11 (port 1) and two output ports 12, 13 (ports 2 and 3). The SIW switch 10 is configured to route electromagnetic signals such as RF signals, microwave signals or millimeter signals through a first transmission path from the input port 11 to the output port 12 or through a second transmission path from the input port 11 to the output port 13.

The SIW switch 10 may be incorporated in a dielectric substrate 20. The dielectric substrate 20 may comprise a circuit board such as a printed circuit board or a low-temperature co-fired ceramic (LTCC).

The substrate 20 is generally a thin film substrate having a thickness thinner than, in most cases, around 600 μm, or thinner than around 500 μm, although thicker substrate structures are technically possible. The thin film substrate comprises an electrically insulating material, e.g., a dielectric material, with or without conductive layers. The substrate may comprise a laminate. The thin film substrate does not include a semiconductor material in some embodiments. Typical thin film substrate materials may be flexible printed circuit board materials such as polyimide foils, polyethylene naphthalate (PEN) foils, polyethylene foils, polyethylene terephthalate (PET) foils, and liquid crystal polymer (LCP) foils. Further substrate materials include polytetrafluoroethylene (PTFE) and other fluorinated polymers, such as perfluoroalkoxy (PFA) and fluorinated ethylene propylene (FEP), Cytop® (amorphous fluorocarbon polymer), and HyRelex materials available from Taconic. In some embodiments the substrate 20 is a multi-dielectric layer substrate.

The switch 10 comprises a first conductive layer or line 15 (e.g., a top metal layer) and a second conductive layer or line 16 (e.g., bottom metal layer). The top conductive layer 15 may comprise the form of a T. The bottom layer 16 may mirror the top layer's T or may be a substantially larger T. Alternatively, the bottom layer 16 may be a plate such as plate covering the entire bottom surface of the substrate 20, or a plate that covers the T of the first conductive layer 15 and at least a majority of the bottom surface of the substrate 20. The top and the bottom conductive layers 15, 16 are parallel to each other and may be disposed on the upper surface and the lower surface of the substrate 20. In alternative embodiments these layers 15, 16 are embedded in the substrate 20.

The top layer 15 and the bottom layer 16 are connected by rows of conductive vertical elements such as conductive cylinders, slots or vias 17, 18, 19. The rows of vertical conductive elements 17, 18, 19 are arranged substantially vertical to the top layer 15 and the bottom layer 16 along the edges of the T. The rows of the vertical elements 17, 18, 19 are substantially parallel to each other in most embodiments. The distance between the rows of conductive vertical elements 17, 18, 19 dependents on the operation frequency of the electromagnetic signal. The materials of the top conductive layer 15, the bottom conductive layer 16, and the rows of vertical conductive elements 17, 18, 19 may be copper, aluminum, alloys of copper or aluminums, or combination thereof. In alternative embodiments other conductive material may be used.

The length of the SIW switch 10 can be selected and adapted based on the particular application. Non-limiting examples of suitable switch lengths can be a few hundred micrometers to tens of millimeters. The height of the conductive vertical elements 17, 18, 19 may correspond to the thickness of the substrate 20.

Figure 1B:
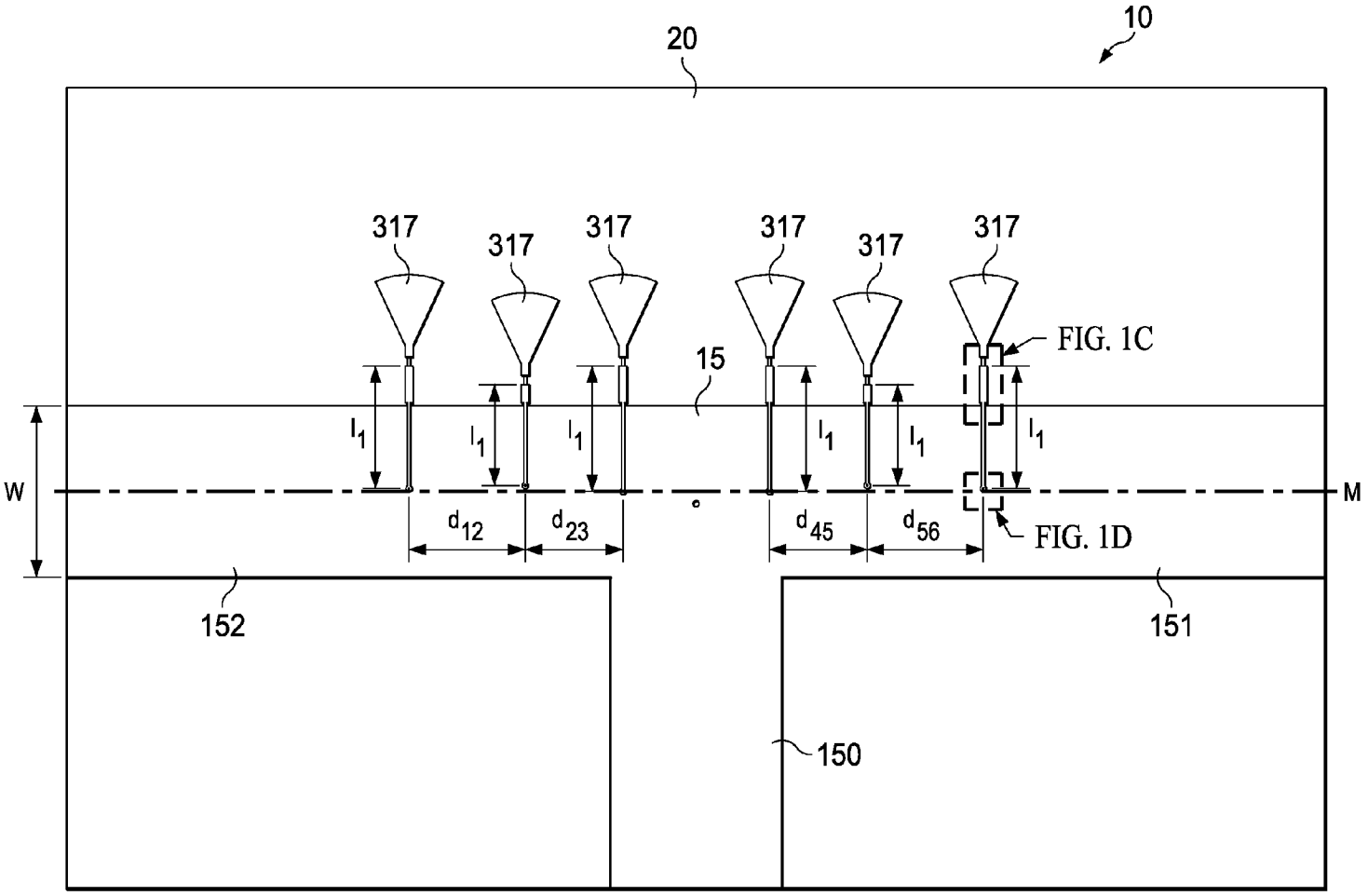
FIG. 1*b* is a top view of the SIW switch.
Figure 1C:
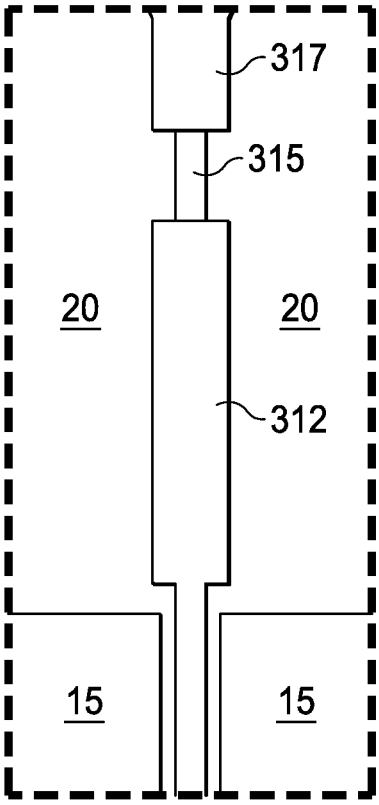
FIG. 1*c* is a detail of the top view of the SIW switch.
Figure 1D:
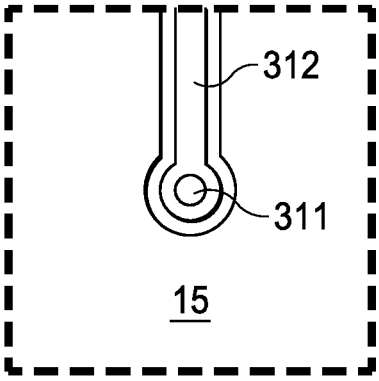
FIG. 1*d* is a further detail of the top view of the SIW switch.

The SIW switch 10 further comprises switching elements such as reconfigurable electromagnetic band gap (EBG) structures 31-36. The switching elements 31-36 are configured to open or block a transmission path for an electromagnetic signal. For example, the switching elements 34-36 can block or pass RF signals (e.g., an RF frequency band) from the input port 11 (through a first transmission arm 150) to the first output port 12 (through a second transmission arm 151) along a first transmission path of the switch 10 and the switching elements 31-33 can block or pass RF signals from the input port 11 (through the first transmission arm 150) to the second output port 13 (through the second transmission arm 152) along a second transmission path. As can be seen from FIGS. 1*a* and 1*b* the second transmission arm 151 (throw prong) and the third transmission arm 152 (throw prong) each comprises three switching elements. In alternative embodiments, the double throw SIW switch 10 may have more or less than three switching elements 31-36 in each throw prong. For example, each throw prong may include 4 or 5 switching elements, or alternatively, only one or two switching elements. The switching elements 31-33 and 34-36 may be periodic switching elements. Increasing the number of switching elements may help to increase the frequency bandwidth of the switch.

As can be seen from FIGS. 1*a*-1*d* each switching element 31-36 comprises an electromagnetic band gap (EBG) structure 311 (e.g., a conductive via), a tunable element 315 (e.g., a PIN diode), a conductive connection line 312 between the EBG structure 311 and the tunable element 315 and an electromagnetic signal (e.g., RF) choke 317 electrically connected to the tunable element 315.

The switching elements 31-36 are able to reconfigure the load of the switching elements 31-36 in the second and third transmission arms (output arms) 151, 152 of the switch 10. By modifying adequately the load of the switching elements 31-36 through the tunable elements 315 the switch 10 can control the propagation of the electromagnetic signal (e.g., RF signal) from the input port 11 to the output ports 12, 13.

The EBG structure 311 may be a conductive via (e.g., metal via) connecting the conductive connection line 312 to the bottom conductive layer 16. The top conductive layer 15 is electrically isolated from the EBG structure 311 and the conductive connection line 312 by the substrate material of the substrate 20 or by an additional dielectric layer. The EBG structure 311 and the conductive connection line 312 may be from the same material. For example, the material may be copper, aluminum, alloys of copper or aluminum, or combinations thereof. The material of the EBG structure 311 and the conductive connection line 312 may be the same as the top metal layer 15. In alternative embodiments the EBG structure 311 may have a mushroom structure.

The conductive connection line 312 may be connected to a tunable element 315. The tunable element may be a diode (such as a PIN diode), a MEMS device, a transistor device or another tunable device. Alternatively, the tunable element 315 is a discrete device or a simple ASIC. The tunable element 315 may be disposed on the substrate 20 (e.g., the circuit board) as a substrate mount device (SMD). Furthermore, a stub 317 is also connected to the tunable element 315. The stub 317 acts as a ground for the electromagnetic signal (e.g., RF signal). For example, the stub 317 may be a quarter wavelength open stub (or RF-choke).

Figure 1E:
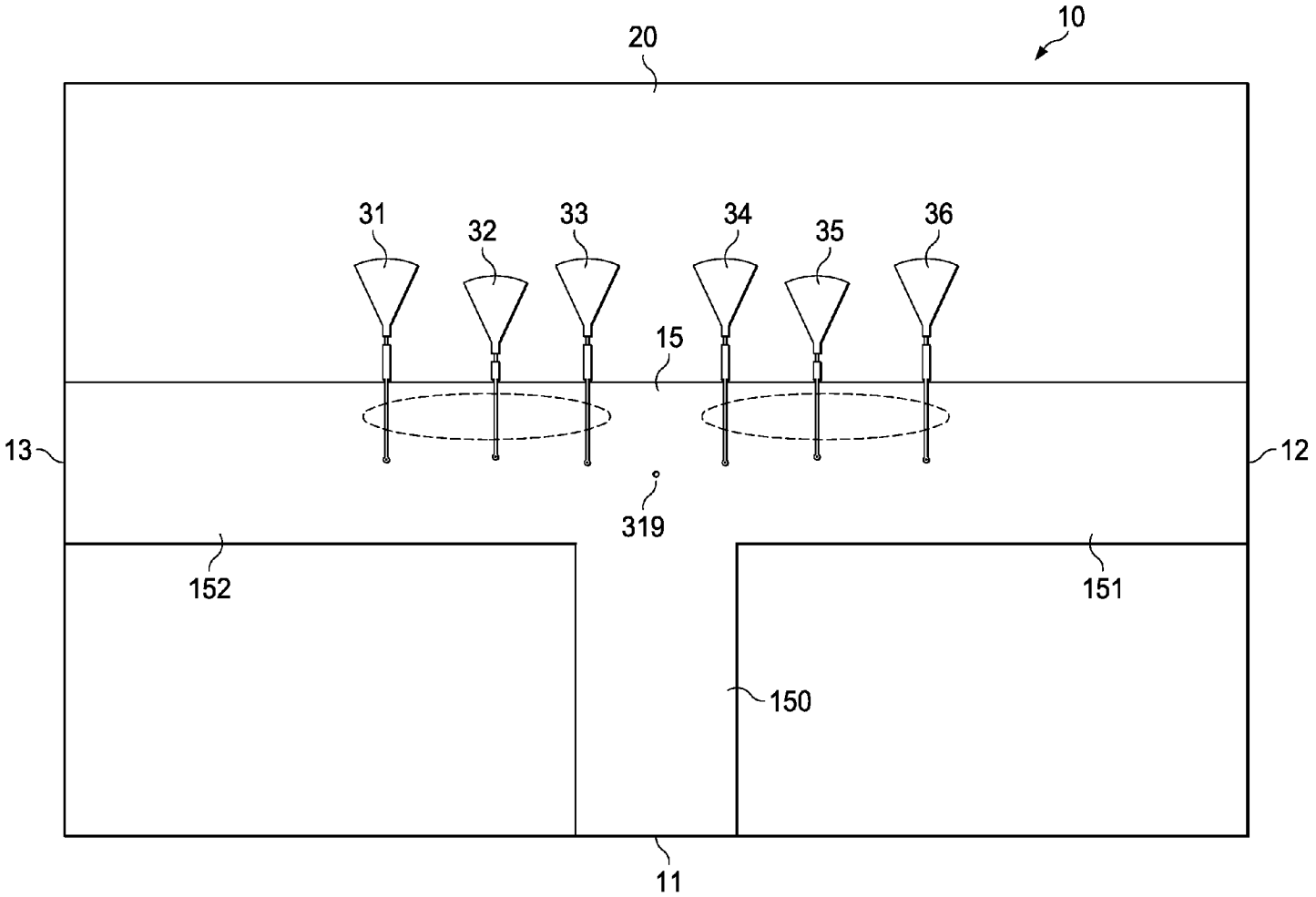
FIG. 1*e* shows a switch configuration of the SIW switch.

The tunable elements 315 may be connected to additional conductive (digital) lines disposed within or on the substrate 20. The additional conductive (digital) lines may be (directly or indirectly) connected to an I/O device or I/O terminal for each tunable element 315. The conductive (digital) line is configured to provide a digital signal to the tunable element 315 in order to switch it ON or OFF. The tunable elements may be selected together or may be selected individually. For example, the tunable elements 315 in each throw prong 152, 153 may be selected and switched together. This is shown in FIG. 1*e*. Other configurations are possible. The tunable elements 315 may be the same elements (e.g., a specific PIN diode). In some embodiments the tunable elements 315 are different, e.g., in diode types or in device types (e.g., some MEMS and some diodes).

When the tunable elements 315 are switched on a DC power is applied to the EBG structure 311 and a certain load (capacitive or inductive) is placed on the EBG structures 311, and when the tunable elements 315 are switched off a different load is applied to the EBG structures 315.

The EBG structures 311 may be located at the middle line M of each throw prong 151, 152 of the top metal layer 15. The middle line M is the middle of the width w of the RF transmission line. In some embodiments the EBG structures 311 may be located substantially at the middle line 15 or anywhere in the width w. The width w of the SIW switch 10 may be about a half of guided wavelength.

The conductive connection lines 312 may comprise different lengths $l_1$. The length $l_1$ is measured from the contact of the EBG structure 311 to the contact of the tunable element 315. For example, the distance is about a little less than a quarter guided waveguide, e.g., a quarter guided wavelength minus less or equal 5%, or alternatively, minus less or equal 10%. In some embodiments all the lengths $l_1$ of the conductive connection lines 312 are different for all switching elements 31-33 and 34-36 in each throw prong 151, 152. Alternatively, the lengths $l_1$ of the two outer conductive connection lines 312 of the switching elements (31 and 33 on throw prong 152 and 34 and 36 on throw prong 151) are the same while the middle conductive connection lines 312 of the switching elements 32 and 35 are the different (shorter or longer). In some embodiments the lengths $l_1$ of the conductive lines 312 of the switching elements 31-33 mirror the lengths $l_1$ of the conductive lines 312 of the switching elements 34-36.

Moreover, the conductive connection lines 312 are laterally spaced apart from each other by a distance d. All the distances may be different. For example, distance $d_{12}$ is different than distance $d_{23}$, and distance $d_{45}$ is different than distance $d_{56}$. The distances d are measured from the middle to middle of adjacent conductive connection lines 312. In some embodiments the distances d of the conductive connection lines 312 of the prong 152 and 151 mirror each other. In other words distance $d_{12}$ is substantially the same as distance $d_{56}$ and distance $d_{23}$ is substantially the same as distance $d_{45}$ in order to keep symmetry between output ports. Substantially the same means within 10% of the measured distance d (e.g., within 10% of the distance $d_{12}$). In some embodiments the distances $d_{12}$ and $d_{23}$ are optimized and can be different to optimize the frequency response of the switch. These distances are about a quarter wavelength of the guided electromagnetic signal. The distance 312 is optimized for each circuit connected to a tunable element to optimize the frequency response of the switch. This distance may be smaller than a quarter guided wavelength. The RF chokes 317 are about a quarter guided wavelength.

Figure 1F:
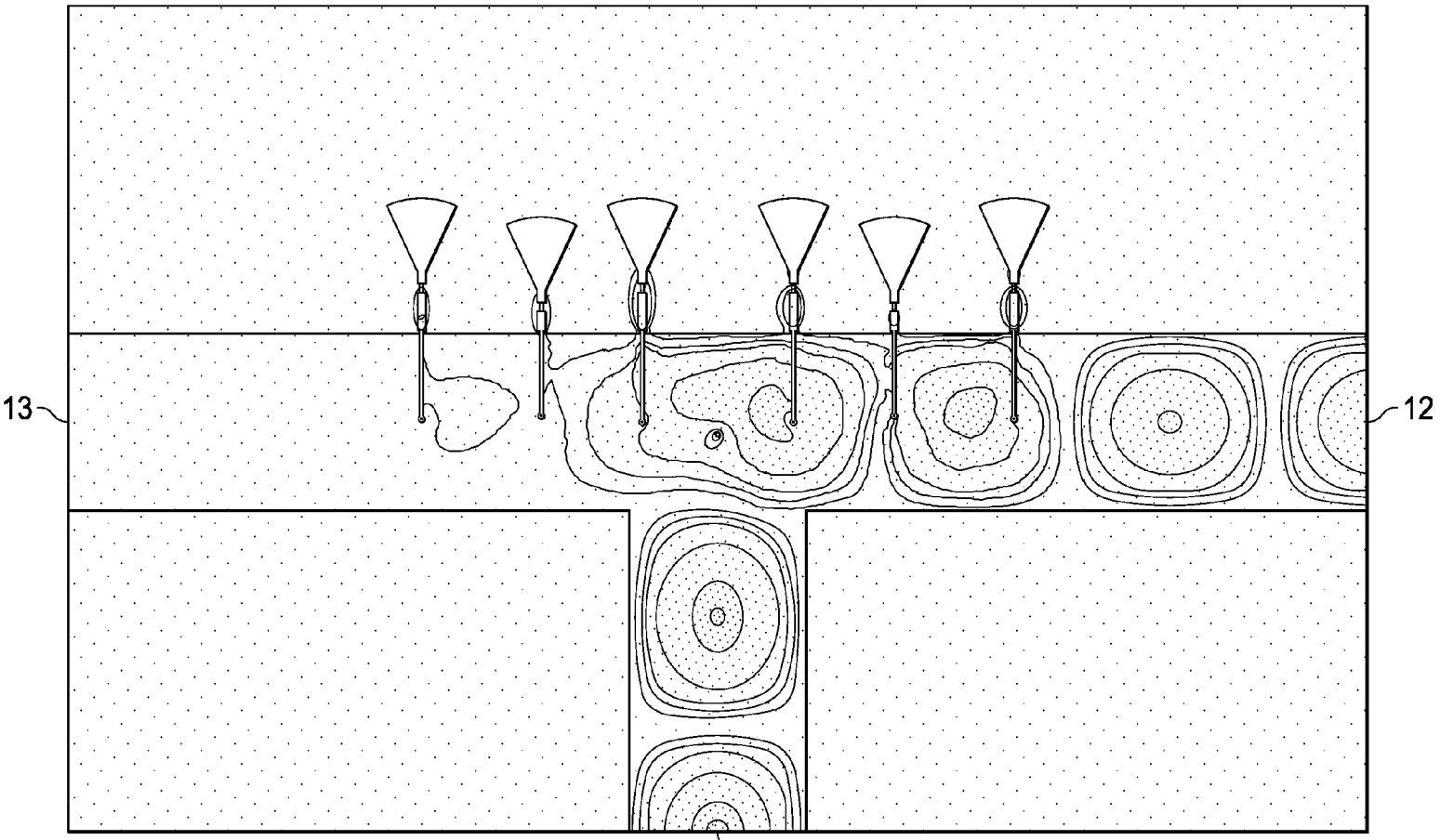
FIG. 1*f* shows an operational stage of the SIW switch.
Figure 1G:
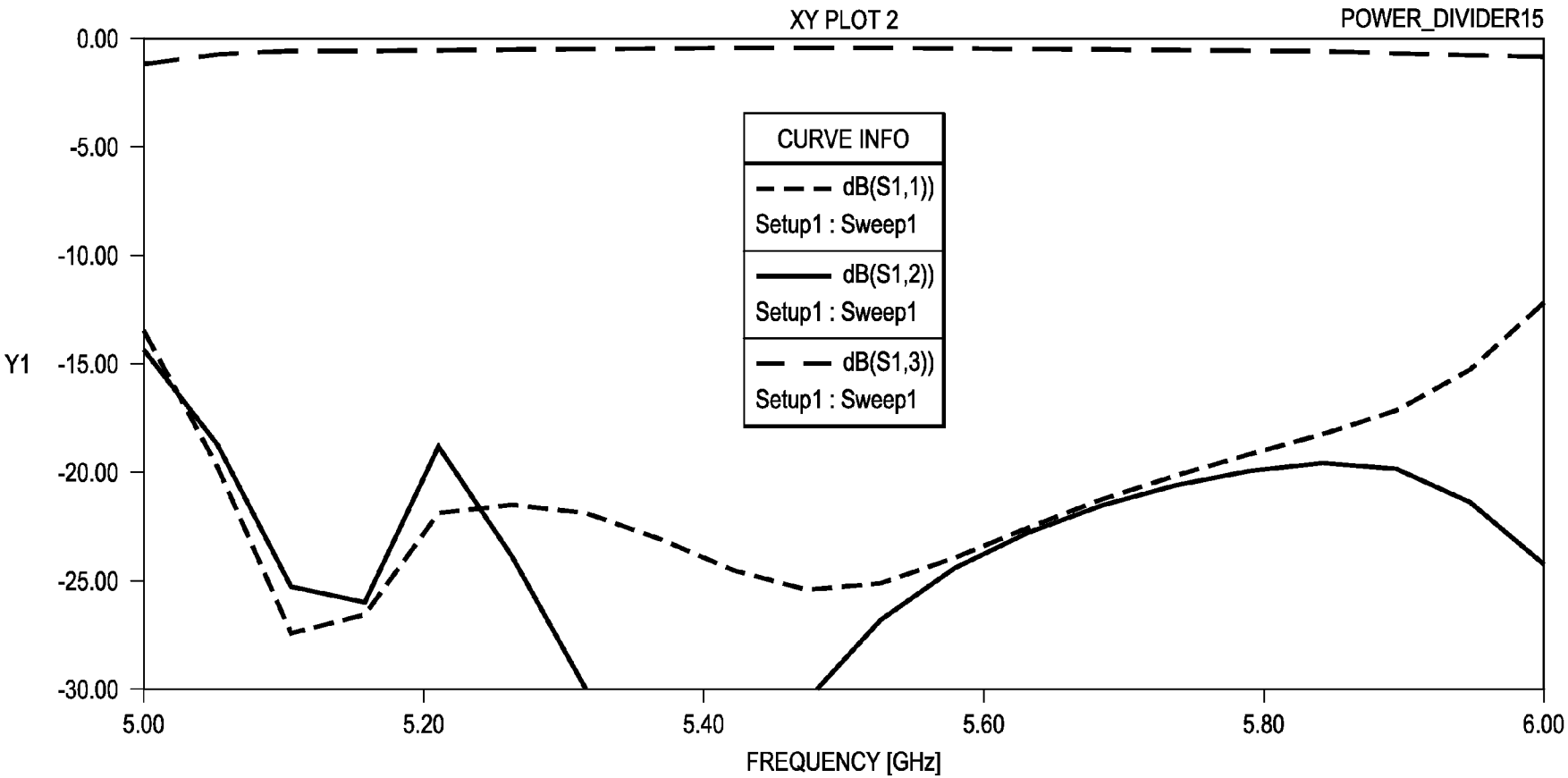
FIG. 1*g* shows loss graphs for the SIW switch.

FIG. 1*e* shows the SIW switch 10 with the switching elements 31-33 operating together and the switching element 34-36 operating together. In operation, the switching elements 31-33 in the third transmission arm 152 are in an ON state (e.g., applying a DC voltage via the DC lines, the DC voltage may be 1.5 V or 5V for example) while the switch elements 34-36 in the second transmission arm 151 are in an OFF state (e.g., applying no DC voltage, e.g., OV, for example). As can be seen from FIG. 1*f*, this creates a transmission path between input port 11 and output port 12 so that a RF signal can pass from the input port 11 to the output Port 12. However, a path is blocked in the third portion 152 and an RF signal is blocked from propagating to the output port 13. Passing and blocking the RF signal means passing and blocking a RF signal for a specific frequency range. The frequency range can be selected by selecting the number of switching elements 31-36 to be placed in the transmission path. The less switching elements the smaller is the pass or stop band of an electromagnetic signal and the more switching elements the larger is the pass or stop band of the electromagnetic signal. For example, three switching elements (e.g., reconfigurable EBG structures) may provide a good pass/stop band for a wide band such as a 1 GHz band, from 5 GHz to 6 GHz as can be seen from FIG. 1*f*.

Figure if shows the high quality of an SIW switch 10 according to embodiments. The insertion loss for a RF transmission in a wide band (1 GHz band between 5 GHz and 6 GHz) between input port 11 and output port 12 is less than 0.5 dB, a return loss at the input port 11 is less than −18 dB and the isolation between port 11 and port 13 is less than −20 dB. These results are obtained with an accurate analysis that takes into account the exact model of a real PIN diode with 2Ω serial resistance.

In some embodiments the SIW switch 10 may have a metal via 319 connecting the top conductive layer 15 to the bottom conductive layer 16 at the center of the T junction. Such metal via 319 may improve the quality of the SIW switch 10 for RF transmissions even further.

Figure 2A:
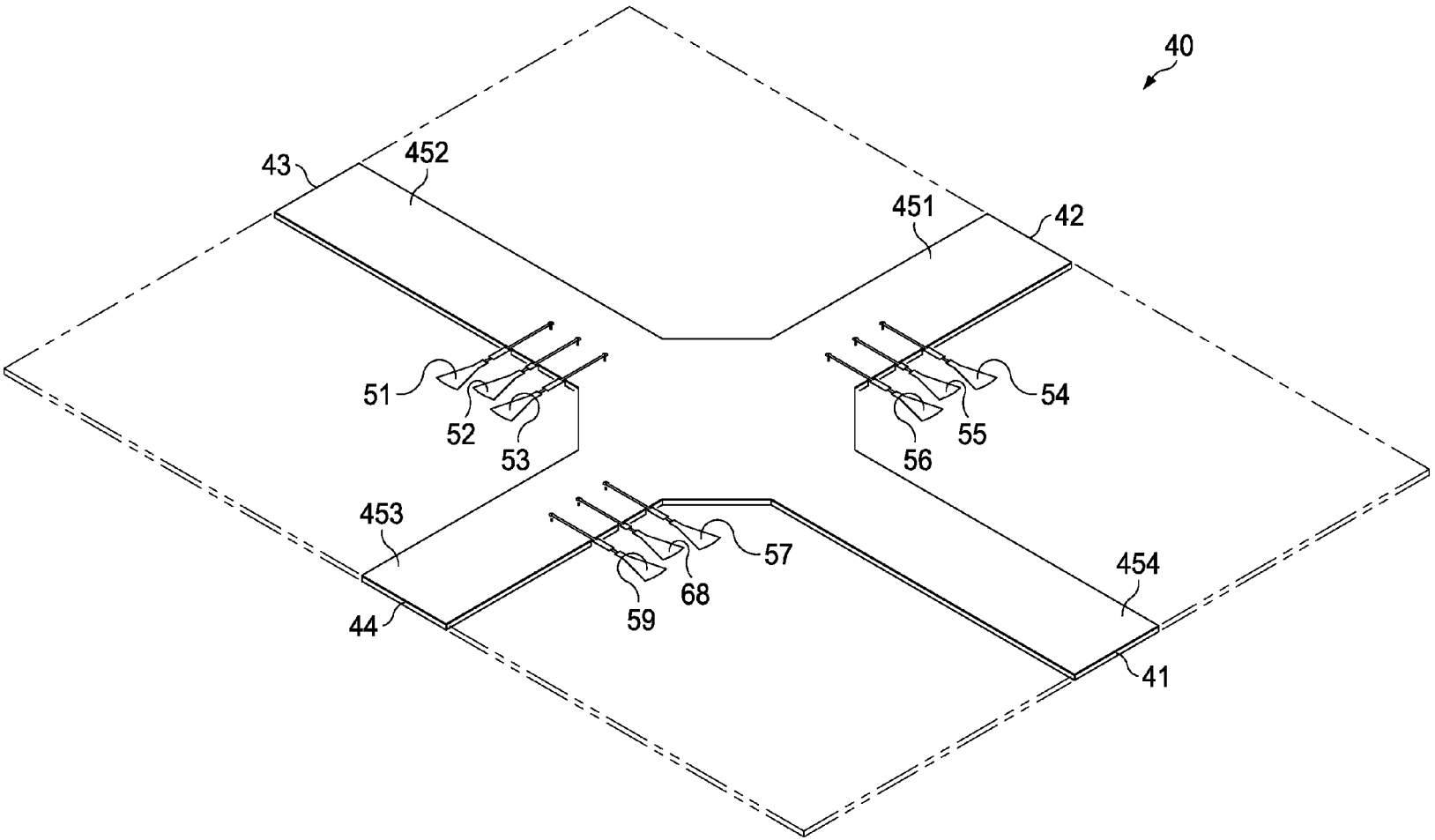
FIG. 2*a* a shows a 3D view of a triple throw SIW switch (a special form of a multi-throw switch) according to an embodiment.
Figure 2B:
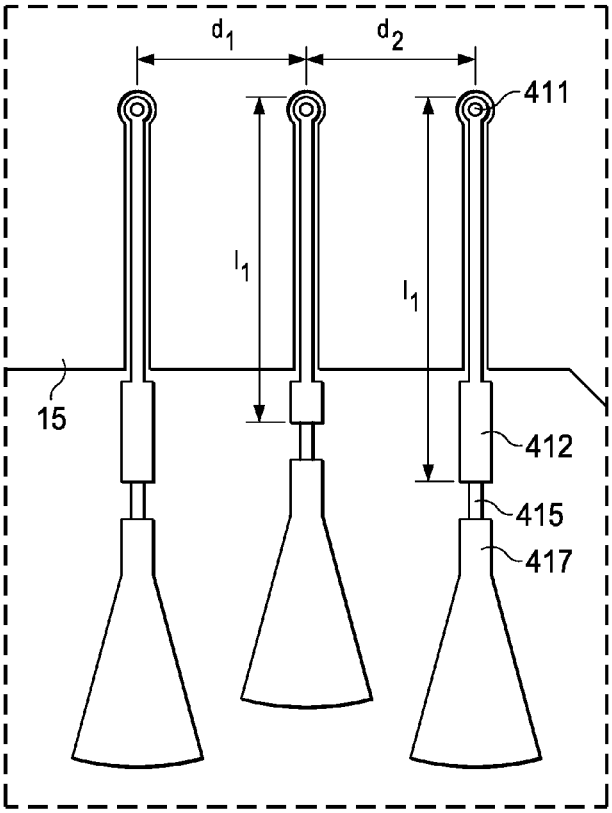
FIG. 2*b* shows a detail of the top view of the SIW switch.

FIG. 2*a* shows a triple throw SIW switch 40. The triple-throw SIW switch 40 may comprise the similar elements as described with respect to FIGS. 1*a*-1*g*. Like numbered elements (e.g., 31-33 and 51-53) are similar. However, instead of having two output ports 12 and 13 the triple-throw SIW switch 40 comprises three output ports 42-44 and an input port 41. The embodiment of the triple-throw SIW switch 40 shows three switching elements 51-53, 54-56, 57-59 for each the output arms (e.g., throw prongs) 451, 452, 453. In other embodiments, the triple-throw SIW switch 40 may have more or less than three switching elements. For example, each output arms of the switch (e.g., throw prong) 451-453 may include 4 or 5 switching elements, or alternatively, only one or two switching elements. As discussed above each switching element 51-59 may comprise an EBG structure 411, a tunable element 415, a conductive connection line 412 between the EBG structure 411 and the tunable element 415 and an electromagnetic signal choke 417 connected to the tunable element 415 in order to ground the electromagnetic signal (e.g., RF signal) at that point.

Also, the same discussion applies with respect to the location of the EBG structure 411 at each output arm 451-453, with respect to the lengths $l_1$ of the conductive connection lines 412, with respect to the distances $d_1$ and $d_2$ between the conductive lines 412 and with respect to the arrangement of the switching elements (e.g., 51-53) in a second transmission arm of the switch (e.g., 451) to the arrangement of the switching elements (e.g., 54-56 or 57-59) in other transmission arms of the switch (e.g., 452 or 453).

In some embodiments, however, the SIW switch 40 may not have a metal via being connected between the top conductive layer 15 and the bottom conductive layer 16 at the center of the junction.

Figure 2C:
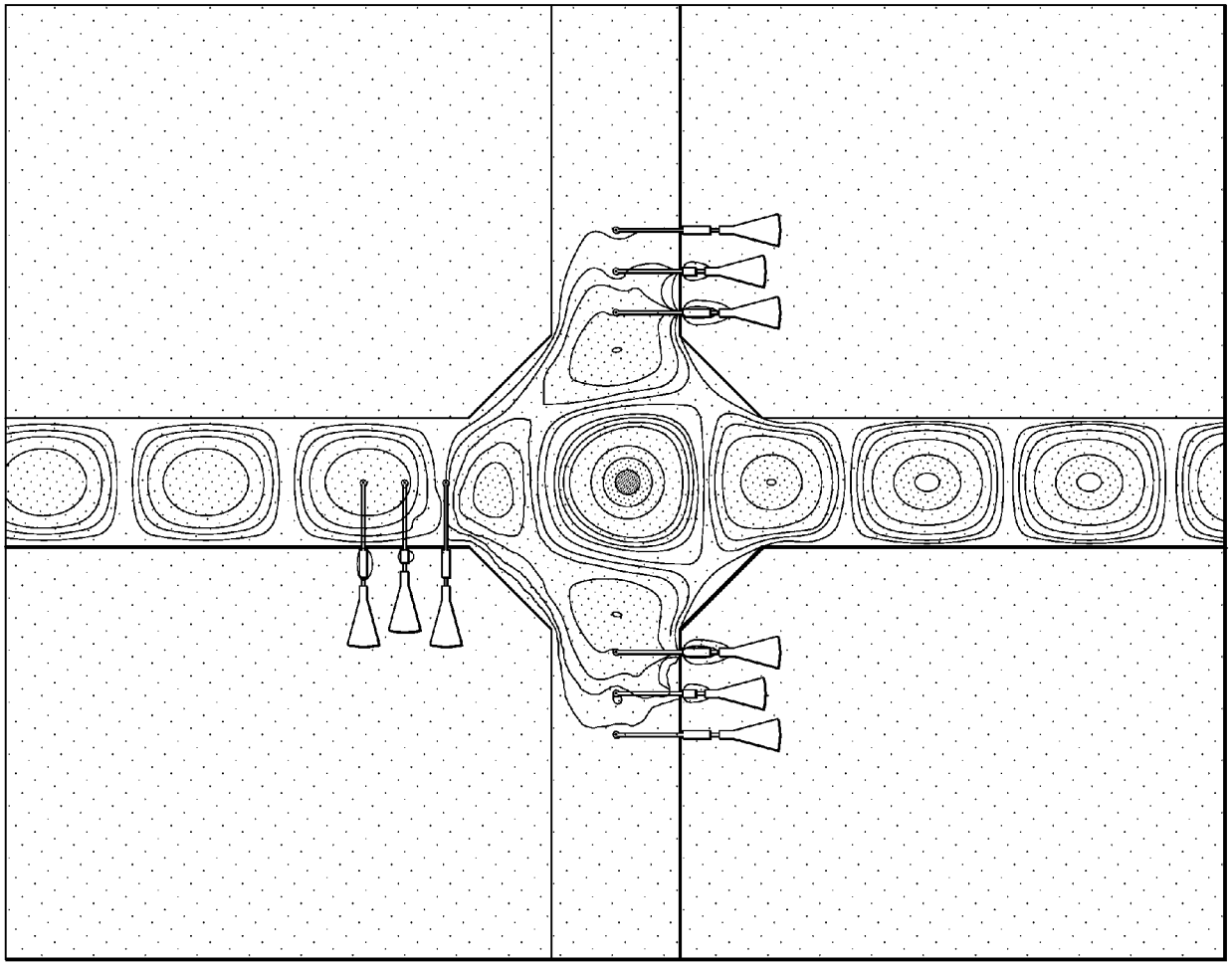
FIG. 2*c* shows an operational stage of the SIW switch according to a first switch configuration.

In simulations the quality of the SIW switch 40 has been tested. FIG. 2*c* shows a simulation result for a configuration where the electromagnetic signal (e.g., RF signal) is feed through the input port 41 and the first input arm of the switch 454, and where the switching elements 54-56 in the second output arm (e.g., throw prong) 451 and the switching elements 57-59 in the fourth output arm (e.g., throw prong) 453 are in an ON state (e.g., applying a DC voltage) while the switching elements 51-53 in the third output arm (e.g., throw prong) 452 are in an OFF state (e.g., applying no DC voltage). As can be seen from FIG. 2*c*, the electromagnetic signal (e.g., RF signal) passes from the input port 41 to the output 43 because the switch 40 has established an open electromagnetic transmission path between these two ports. The electromagnetic signal, however, is effectively blocked from propagating to output ports 44 and 42.

Figure 2D:
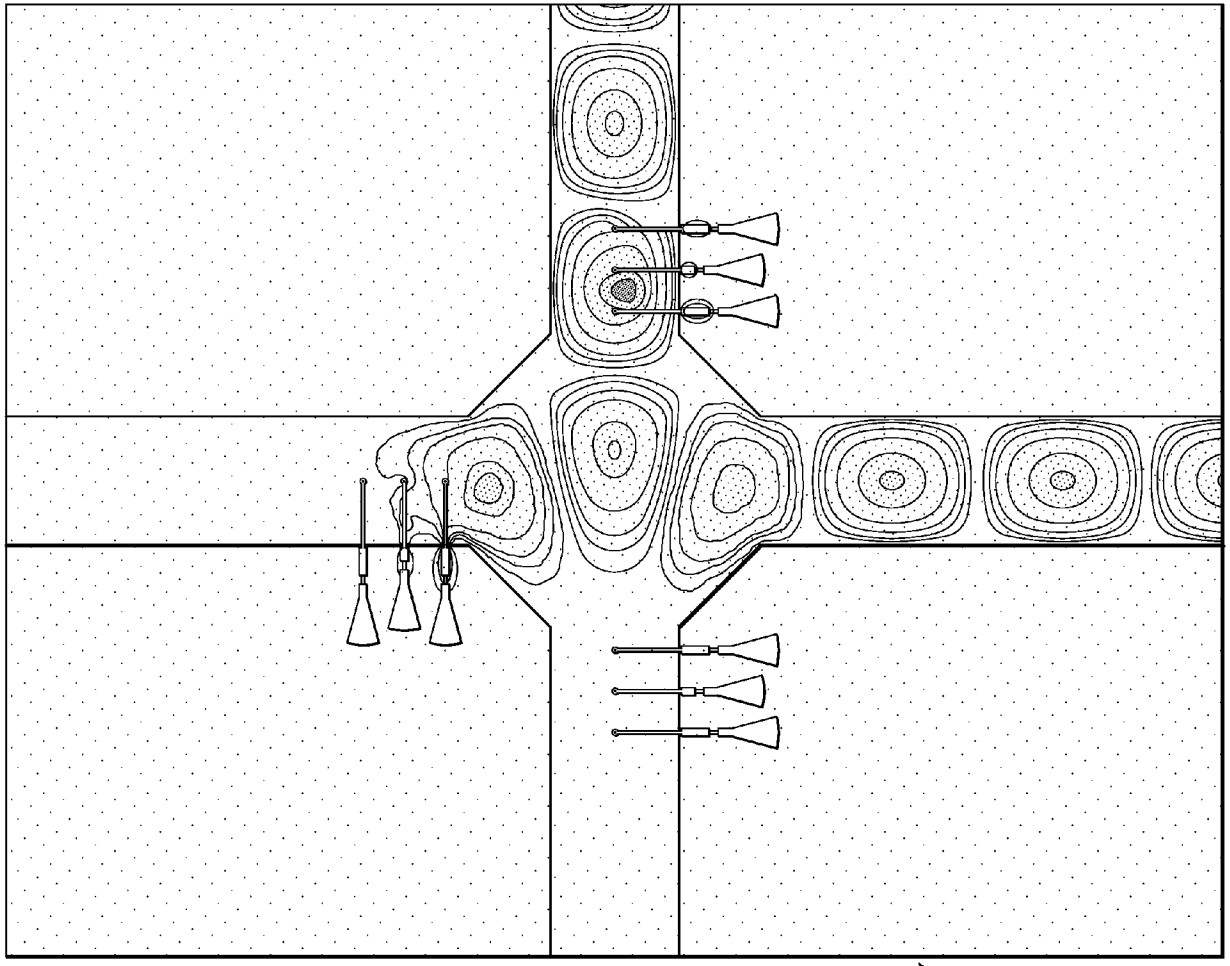
FIG. 2*d* shows an operational stage of the SIW switch according to a second switch configuration.

FIG. 2*d* shows a simulation result for a configuration where the switching elements 51-53 in the third output arm 452 and the switching elements 57-59 in the fourth output arm 453 are in an ON state (e.g., applying a DC voltage) while the switching elements 54-56 in the second output arm 451 are in an OFF state (e.g., applying no DC voltage). As can be seen from FIG. 2*d*, the electromagnetic signal (e.g., RF signal) passes from the input port 41 to the output 42 because an open transmission path is established between these two ports. The electromagnetic signal (e.g., RF signal), however, is effectively blocked to propagate to output ports 43 and 44.

Figure 2E:
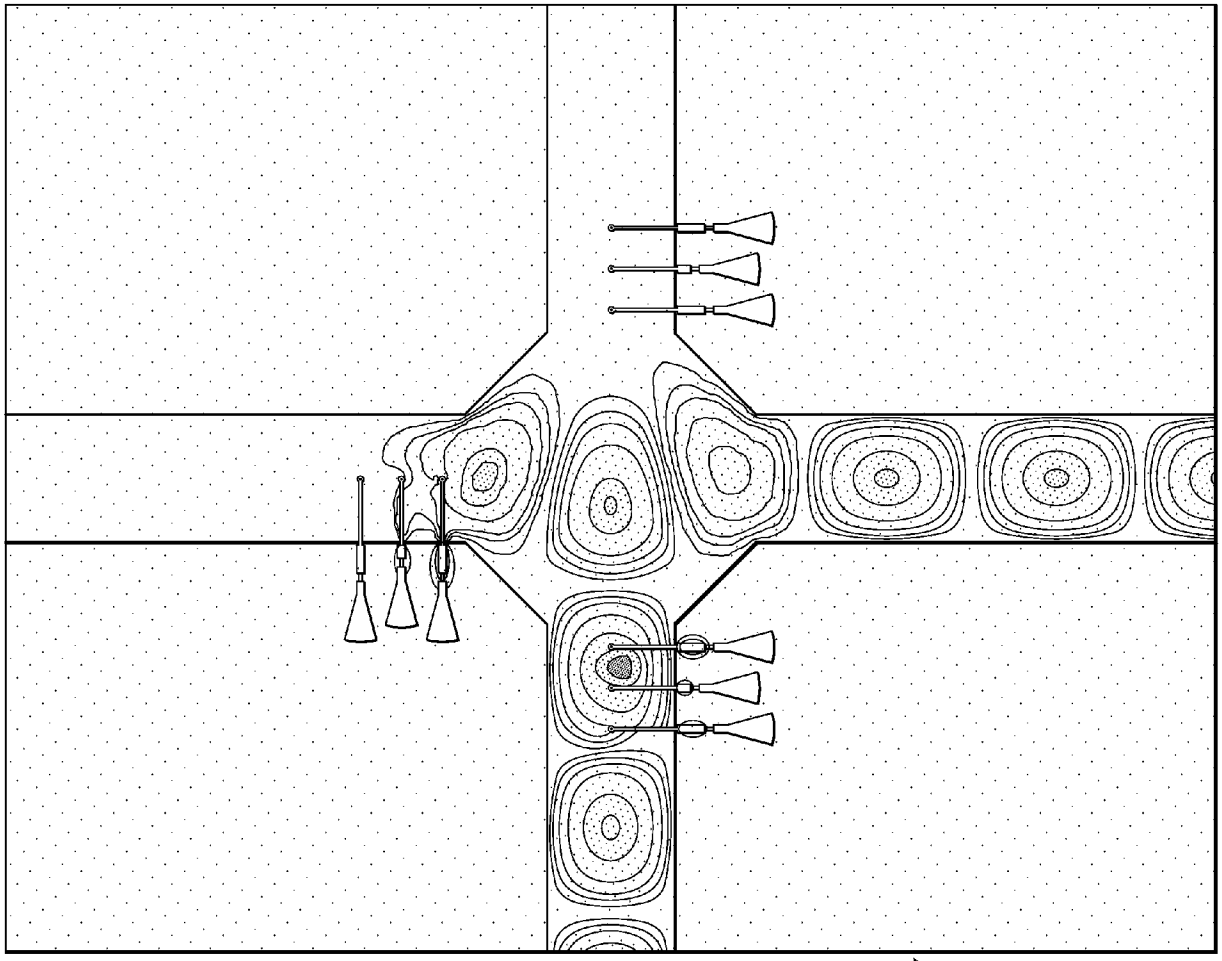
FIG. 2*e* shows an operational stage of the SIW switch according to a third switch configuration.

FIG. 2*e* shows a simulation result for a configuration where the switching elements 51-53 in the third output arm 452 and the switching elements 54-56 in the second output arm 452 are in an ON state (e.g., applying a DC voltage) while the switching elements 57-59 in the fourth output arm 453 are in an OFF state (e.g., applying no DC voltage). As can be seen from FIG. 2*e*, the electromagnetic signal (e.g., RF signal) passes from the input port 41 to the output 44 because an open transmission path is established between these two ports. The electromagnetic signal (e.g., RF signal), however, is effectively blocked to pass to output ports 42 and 43.

FIGS. 3*a*-3*d* show a triple throw SIW switch (with coaxial feed line 60 (e.g., coaxial cable)). The triple-throw switch 60 may comprise similar elements as described with respect to FIGS. 1*a*-1*g*. Like numbered elements (e.g., 31-33 and 71-73) are similar. However, instead of two output ports 12 and 13 the triple-throw SIW 60 comprises three output ports 61-63 and a coaxial feed line 60. The embodiment of the triple-throw SIW switch 60 shows three switching elements 71-73, 74-76, 77-79 for each output arm of the switch (e.g., throw prong) 651, 652, 653. In other embodiments, the triple-throw SIW switch 6*o* may have more or less than three switching elements. For example, each output arm 651-653 may include 4 or 5 switching elements, or alternatively, only one or two switching elements. As discussed above each switching element 71-79 may comprise an EBG structure, a tunable element, a conductive connection line between the EBG structure and the tunable element and an RF choke connected to the tunable element in order to ground the RF signal at that point and to isolate the DC signal form the RF signal.

Also, the same discussion applies with respect to the location of the EBG structure at each output arm element 651-653, with respect to the lengths $l_1$ of the conductive connection lines, with respect to the distances between the conductive lines and with respect to the arrangement of the switching elements (e.g., 71-73) in an output arm (e.g., 651) to the arrangement of the switching elements (e.g., 74-76 or 77-79) in other output arms (e.g., 652 or 653).

In some embodiments, however, the SIW switch 60 may have three metal vias 81-83 being connected between the top conductive layer 15 and the bottom conductive layer 16 at the junction. The metal vias may be symmetrically located around the coaxial feed line (e.g., coaxial cable) 84. The positions of these vias are optimized for a good frequency response of the switch.

Figure 3A:
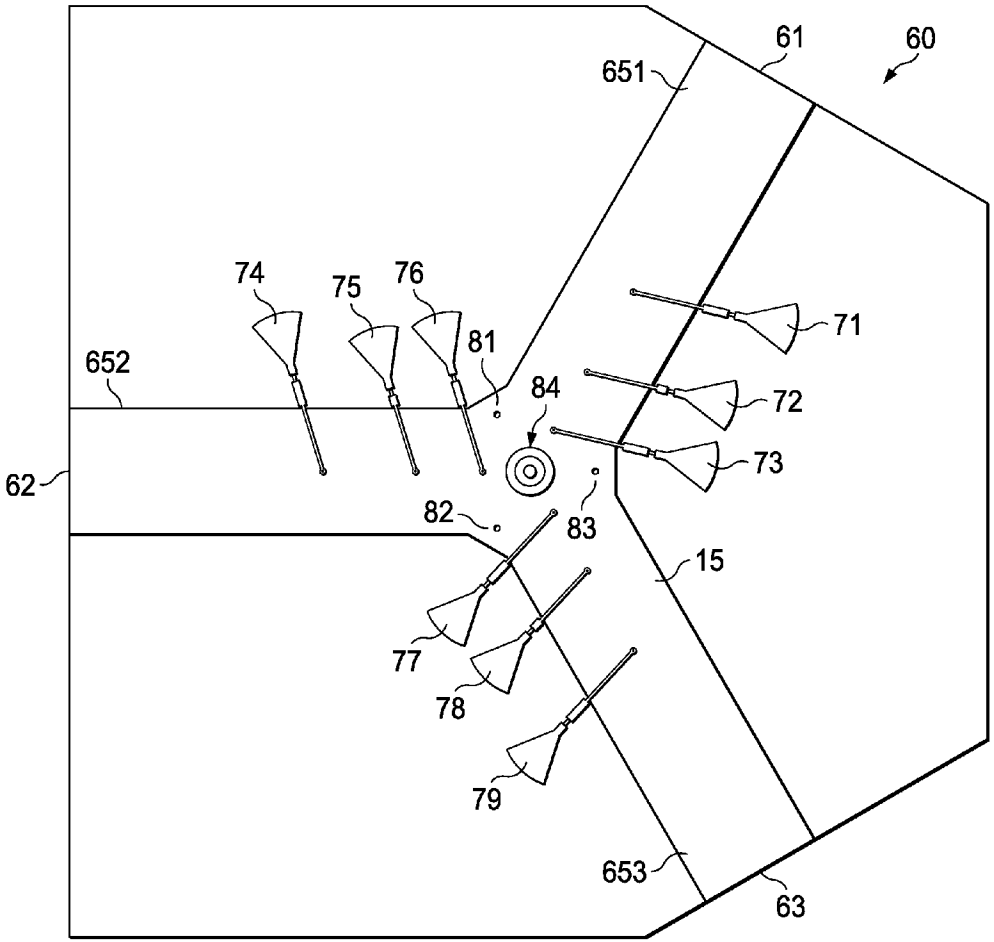
FIG. 3*a* shows a top view of a triple throw SIW switch (a special form of a multi-throw switch) according to an embodiment.
Figure 3B:
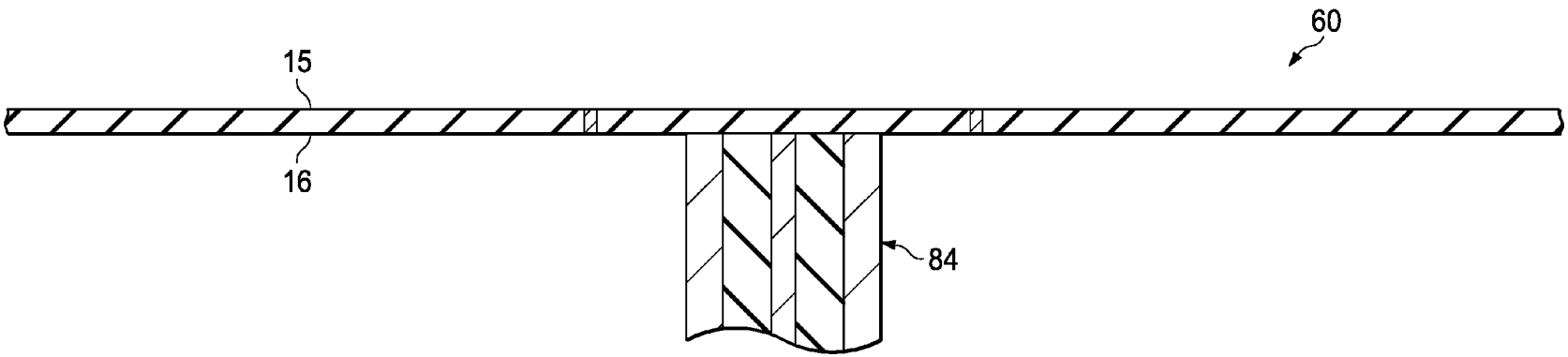
FIG. 3*b* shows a cross-sectional view of the SIW switch.
Figure 3C:
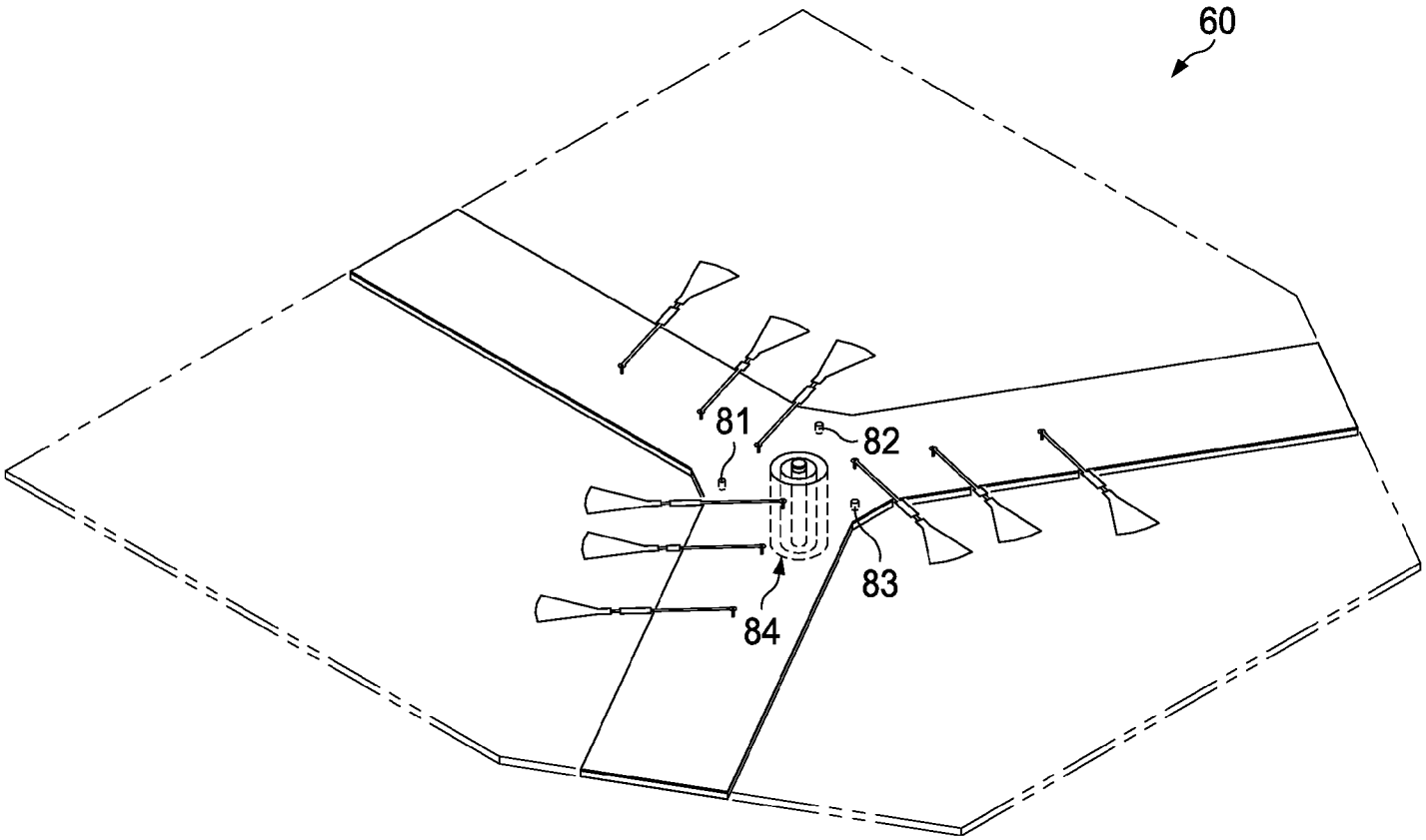
FIG. 3*c* shows a detail of the top view of the SIW switch.
Figure 3D:
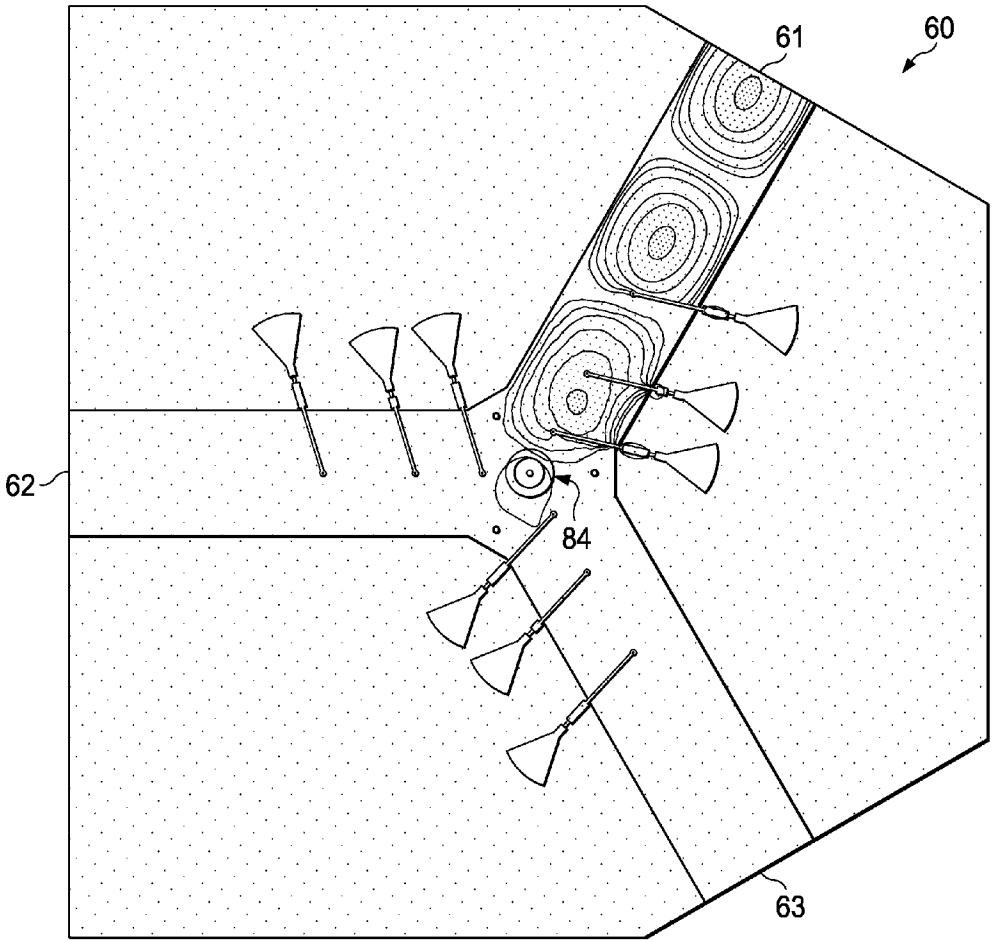
FIG. 3*d* shows operational stages of the SIW switch.

In simulations the quality of the SIW switch 60 has been tested. FIG. 3*d* shows a simulation result for a configuration where the electromagnetic signal is fed through the coaxial feed line 84 to the SIW switch 60 and where the switching elements 74-76 in the second output arm 52 and the switching elements 77-79 in the third output arm 653 are in an ON state (e.g., applying a DC voltage) while the switching elements 71-73 in the first output arm 651 are in an OFF state (e.g., applying DC voltage). As can be seen from FIG. 3*d*, the electromagnetic signal (e.g., RF signal) passes from the coaxial feed 84 to the output port 61 because the SIW switch 60 established an open transmission path between these locations. The electromagnetic signal, however, is effectively blocked to propagate to output ports 62 and 63.

Figure 4:
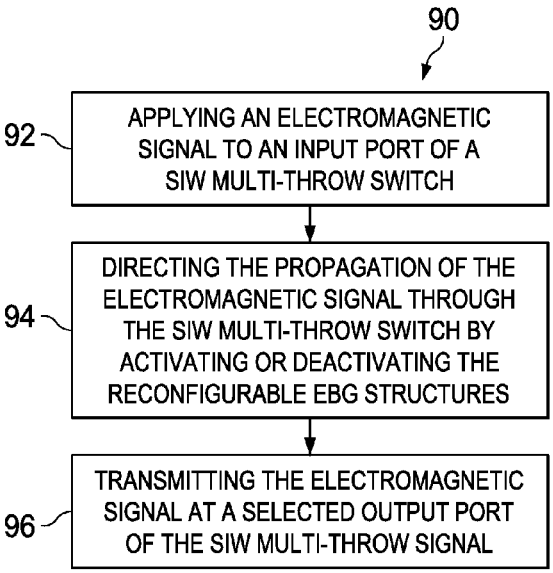
FIG. 4 shows a method for operating the SIW switch.

FIG. 4 shows a method 90 for operating a SIW switches according to embodiments. In a first step 92, an electromagnetic signal (e.g., RF signal, microwave signal or millimeter signal) is applied to an input port of the SIW switch. The input port may be at a pole of the switch or may be connected to a feed line such as a coaxial feed line. In the next step 94, the propagation of the electromagnetic signal through the SIW switch is directed by activating or deactivating the switching elements (e.g., reconfigurable EBG structures) in the output arms (e.g., throw prongs) of the SIW switch. The switching elements (e.g., reconfigurable EBG structures) are activated or deactivated as described with respect to embodiments herein. The EBG structures can block or pass the propagation of the electromagnetic signal. The reconfigurable EBG structures can direct the electromagnetic signal to a selected output port. In step 96 the electromagnetic signal is transmitted, e.g., to a waveguide, at the selected output port of the SIW switch.

Further embodiments may comprise double-pole-double throw switches to switch between two inputs ports and two output ports or any other single or multi-pole multi throw switch.

Other embodiments may include a single pole-single throw switch. A system based on a single pole single throw switch may include a dielectric substrate, and a single pole-single-throw switch supported by the dielectric substrate, wherein the single-throw switch includes a transmission path and at least one switching element in the transmission path, wherein the single-throw switch is configured to direct propagation of an electromagnetic signal along the transmission path when the at least one switching element passes the electromagnetic signal and wherein the single-throw switch is configured to block the propagation of the electromagnetic signal along the transmission path when the at least one switching element blocks the electromagnetic signal. The single pole-single throw switch can be combined with all disclosed switching elements embodiments.

Embodiments of the invention may be applied to radar system such as automotive radar or telecommunication applications such as transceiver applications in base stations or user equipment (e.g., hand held devices).

Embodiments of the invention include a system comprising a dielectric substrate and a multi-throw switch supported by the dielectric substrate comprising, wherein the multi-throw switch includes at least one first transmission path, a second transmission path and at least one switching element located in each transmission path, wherein the multi-throw switch is configured to direct propagation of an electromagnetic signal along the at least one first transmission path when at least one first switching element passes the electromagnetic signal and at least one second switching element blocks the electromagnetic signal, and wherein the multi-throw switch is configured to direct the propagation of the electromagnetic signal along the second transmission path when the at least one second switching element passes the electromagnetic signal and the at least one first switching element blocks the electromagnetic signal.

Embodiments of the invention provide that the at least one switching element comprises an EBG structure and a tunable element, wherein the at least one switching element is configured to pass the electromagnetic signal when the tunable element applies a load to the EBG structure, and wherein the switching element is configured to block the electromagnetic signal when the tunable element applies a different load to the EBG structure.

Embodiments of the invention provide that the tunable element is a PIN diode or a MEMS device.

Embodiments of the invention provide that the at least one switching element comprises at least two switching elements, each switching element comprises an EBG structure electrically connected to a tunable element through a conductive connection line, and wherein the conductive connection lines do not have the same length.

Embodiments of the invention further provide that the at least one switching element comprises at least three switching elements, each switching element comprises an EBG structure electrically connected to a tunable element through a conductive connection line, and wherein a distance $d_1$ between a first conductive connection line and a second conductive connection line is different to a distance $d_2$ between the second conductive connection line and a third conductive connection line.

Embodiments of the invention further include a third transmission path, wherein the multi-throw switch is configured to direct propagation of an electromagnetic signal along a third transmission path when at least one third switching element passes the electromagnetic signal and the at least one first and second switching elements block the electromagnetic signal.

Embodiments of the invention provide that the multi-throw switch is a single pole double-throw switch, a single pole triple-throw switch, or a double pole double-throw switch.

Embodiments of the invention further include a coaxial cable connected to the multi-throw switch.

Embodiments of the invention comprise a system including a dielectric substrate comprising an upper surface and a lower surface, an upper conductive layer disposed at the upper surface, the upper conductive layer comprising transmission arms and a lower conductive layer disposed at the lower surface. The system further comprises vertical conductive elements located at edges of the transmission arms of the upper conductive layer, the vertical conductive elements electrically connecting the upper conductive layer with the lower conductive layer, and reconfigurable electromagnetic band gap (EBG) structures located at least at some transmission arms, the reconfigurable EBG structures configured to pass or block an electromagnetic signal through the respective transmission arms.

Embodiments of the invention provide that the reconfigurable EBG structure comprises an EBG structure and a tunable element, wherein the reconfigurable EBG structure is configured to pass the electromagnetic signal when the tunable element does not apply a load to the EBG structure, and wherein the reconfigurable EBG structure is configured to block the electromagnetic signal when the tunable element applies the load to the EBG structure.

Embodiments of the invention provide that the reconfigurable EBG structures located at least at some of the transmission arms comprises the reconfigurable EBG structures located at two output arms and not located at an input arm.

Embodiments of the invention provide that the reconfigurable EBG structures located at least at some of the transmission arms comprises the reconfigurable EBG structures located at three output arms and not located at an input arm.

Embodiments of the invention provide that the reconfigurable EBG structures located at least at some of the transmission arms comprises the reconfigurable EBG structures located at all output arms and further comprising a feed line connected to the lower conductive layer.

Embodiments of the invention provide that the feed line comprises a coaxial cable.

Embodiments of the invention provide that each transmission arm that comprises the reconfigurable EBG structures comprises at least two reconfigurable EBG structures, each reconfigurable EBG structure comprises an EBG structure electrically connected to a tunable element through a conductive connection line, and wherein the conductive connection lines do not have the same length.

Embodiments of the invention provide that each transmission arm that comprises the reconfigurable EBG structures comprises at least three reconfigurable EBG structures, each reconfigurable EBG structure comprises an EBG structure electrically connected to a tunable element through a conductive connection line, and wherein a distance $d_1$ between a first conductive connection line and a second conductive connection line is different to a distance $d_2$ between the second conductive connection line and a third conductive connection line.

Embodiments of the invention provide a method comprising applying the electromagnetic signal to the system, blocking the electromagnetic signal to a first output port by applying a load to reconfigurable EBG structures in a first transmission arm, and passing the electromagnetic signal to a second output port by not applying the load to reconfigurable EBG structures in a second transmission arm.

Embodiments provide an arrangement comprising a system, wherein the system comprises a dielectric substrate and a multi-throw switch supported by the dielectric substrate, wherein the multi-throw switch includes at least one first transmission path, a second transmission path, and at least one switching element located in each transmission path, wherein the multi-throw switch is configured to direct propagation of an electromagnetic signal along the at least one first transmission path when at least one first switching element passes the electromagnetic signal and at least one second switching element blocks the electromagnetic signal, and wherein the multi-throw switch is configured to direct the propagation of the electromagnetic signal along the second transmission path when the at least one second switching element passes the electromagnetic signal and the at least one first switching element blocks the electromagnetic signal.

Embodiments of the invention provide that the system is a base station, a user equipment or a radar.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A system comprising:

a dielectric substrate comprising an upper surface and a lower surface;

an upper conductive layer disposed at the upper surface;

a lower conductive layer disposed at the lower surface; and a single-throw switch supported by the dielectric substrate, wherein the single-throw switch includes a transmission path and at least one tunable switching element in the transmission path, wherein the at least one tunable switching element comprises a diode, a via, and a connective line electrically connecting the via and the diode, wherein the connective line comprises a first portion and a second portion, the first portion embedded in the upper conductive layer without being in direct physical contact with the upper conductive layer, the second portion being wider than the first portion and located outside the upper conductive layer, wherein the single-throw switch is configured to direct propagation of an electromagnetic signal along the transmission path when the at least one tunable switching element passes the electromagnetic signal, wherein the single-throw switch is configured to block the propagation of the electromagnetic signal along the transmission path when the at least one tunable switching element blocks the electromagnetic signal, and wherein the system is a substrate integrated waveguide (SIW).

2. A system comprising:

a dielectric substrate comprising an upper surface and a lower surface;

an upper conductive layer disposed at the upper surface;

a lower conductive layer disposed at the lower surface; and a multi-throw switch supported by the dielectric substrate, the multi-throw switch comprising:

at least one first transmission path;

at least one first tunable switching element in each of the at least one first transmission path;

a second transmission path; and at least one second tunable switching element in the second transmission path, wherein each of the at least one first tunable switching element and the at least one second tunable switching element comprises a diode, a via, and a connective line electrically connecting the via and the diode, wherein the connective line comprises a first portion and a second portion, the first portion embedded in the upper conductive layer without being, in direct physical contact with the upper conductive layer, the second portion being wider than the first portion and located outside the upper conductive layer, wherein the multi-throw switch is configured to direct propagation of an electromagnetic signal along the at least one first transmission path when the at least one first tunable switching element passes the electromagnetic signal and the at least one second tunable switching element blocks the electromagnetic signal, wherein the multi-throw switch is configured to direct the propagation of the electromagnetic signal along the second transmission path when the at least one second tunable switching element passes the electromagnetic signal and the at least one first tunable switching element blocks the electromagnetic signal, and wherein the system is a substrate integrated waveguide (SIW).

3. The system according to claim 2, wherein each of the at least one first and second tunable switching elements is configured to pass the electromagnetic signal when the diode applies a load to the via, wherein each of the at least one first and second tunable switching elements is configured to block the electromagnetic signal when the diode applies a different load to the via, and wherein different states of each diode are controlled by a dc voltage.

4. The system according to claim 2, wherein each of the at least one first and second tunable switching elements comprises at least two vias, two diodes and two conductive lines electrically connecting the vias and the diodes, wherein the conductive connection lines do not have the same length, and wherein each of the at least one first and second tunable switching elements is a reconfigurable electromagnetic band gap (EBG) structure.

5. The system according to claim 2, wherein each of the at least one first and second tunable switching elements comprises at least three vias, three diode and three conductive lines electrically connecting the vias and the diodes, wherein a distance $d_1$ between a first conductive connection line and a second conductive connection line is different to a distance $d_2$ between the second conductive connection line and a third conductive connection line, and wherein each of the at least one first and second tunable switching elements is a reconfigurable electromagnetic band gap (EBG) structure.

6. The system according to claim 2, further comprising a third transmission path, wherein the multi-throw switch is configured to direct propagation of an electromagnetic signal along a third transmission path when at least one third switching element passes the electromagnetic signal and the at least one first and second tunable switching elements block the electromagnetic signal.

7. The system according to claim 2, further comprising a coaxial cable connected to the multi-throw switch.

8. The system according to claim 2, wherein the connective line is of variable width.

9. The system according to claim 2, wherein the via is connected to the lower conductive layer, and the connective line is indirectly connected to the upper conductive layer through the via, the lower conductive layer, and at least one vertical conductive element connecting the lower conductive layer and the upper conductive layer.

10. The system according to claim 2, wherein the connective line comprises a section located outside the at least one slot of the upper conductive layer.

11. A system comprising:

a dielectric substrate comprising an upper surface and a lower surface;

an upper conductive layer disposed at the upper surface, the upper conductive layer comprising transmission arms;

a lower conductive layer disposed at the lower surface;

vertical conductive elements located at edges of the transmission arms of the upper conductive layer, the vertical conductive elements electrically connecting the upper conductive layer with the lower conductive layer; and reconfigurable electromagnetic band gap (EBG) structures located at least at some transmission arms, the reconfigurable EBG structures configured to pass or block an electromagnetic signal through the respective transmission arms, wherein the system is a substrate integrated waveguide (SIW).

12. The system according to claim 11, wherein the reconfigurable EBG structure comprises a via, a diode and a connective line electrically connecting the via and the diode, wherein the reconfigurable EBG structure is configured to pass the electromagnetic signal when the diode is in an OFF state, wherein the reconfigurable EBG structure is configured to block the electromagnetic signal when the diode in an ON state, and wherein the different states of each diode are controlled by a dc voltage.

13. The system according to claim 11, wherein the reconfigurable EBG structures located at least at some of the transmission arms comprises the reconfigurable EBG structures located at two output arms and not located at an input arm.

14. The system according to claim 11, wherein the reconfigurable EBG structures located at least at some of the transmission arms comprises the reconfigurable EBG structures located at three output arms and not located at an input arm.

15. The system according to claim 11, wherein the reconfigurable EBG structures located at least at some of the transmission arms comprises the reconfigurable EBG structures located at all output arms and further comprising a feed line connected to the lower conductive layer.

16. The system according to claim 15, wherein the feed line comprises a coaxial cable.

17. The system according to claim 11, wherein each transmission arm that comprises the reconfigurable EBG structures comprises at least two vias, two diodes and two conductive lines electrically connecting the vias and the diodes, wherein each reconfigurable EBG structure is configured to pass the electromagnetic signal when the diode is in an OFF state, wherein each reconfigurable EBG structure is configured to block the electromagnetic signal when the diode is an ON state, and wherein the conductive connection lines do not have the same length.

18. The system according to claim 11, wherein each transmission arm that comprises the reconfigurable EBG structures comprises at least three vias, three diodes and three conductive lines electrically connecting the vias and the diodes, wherein each reconfigurable EBG structure is configured to pass the electromagnetic signal when the diode is in an OFF state, wherein each reconfigurable EBG structure is configured to block the electromagnetic signal when the diode is an ON state, and wherein a distance $d_1$ between a first conductive connection line and a second conductive connection line is different to a distance $d_2$ between the second conductive connection line and a third conductive connection line.

19. A method for operating the system, the method comprising:

applying the electromagnetic signal to the system of claim 11;

blocking the electromagnetic signal to a first output port by switching the diodes of the reconfigurable EBG structures to ON states in a first transmission arm; and passing the electromagnetic signal to a second output port by switching the diodes of the reconfigurable EBG structures to OFF states in a second transmission arm.

20. The system of claim 11, wherein the vertical conductive elements comprise a plurality of distinct and independent vertical conductive connection elements connecting the upper conductive layer with the lower conductive layer, and wherein the vertical conductive connection elements are located in rows along edges of the transmission arms of the upper conductive layer.

21. The system according to claim 11, wherein each reconfigurable EBG structure comprises a via, a diode, and a conductive line electrically connecting the via and the diode, wherein the reconfigurable EBG structure is configured to pass the electromagnetic signal when the diode is in an ON state, wherein the reconfigurable EBG structure is configured to block the electromagnetic signal when the diode is in an OFF state, wherein the states of the diode is controlled by a dc voltage.

22. An arrangement comprising:

a substrate integrated waveguide (SIW) comprising:

a dielectric substrate comprising an upper surface and a lower surface;

an upper conductive layer disposed at the upper surface;

a lower conductive layer disposed at the lower surface; and a multi-throw switch supported by the dielectric substrate, the multi-throw switch comprising:

at least one first transmission path;

at least one first tunable switching element in each first transmission path;

a second transmission path; and at least one second tunable switching element in each second transmission path, wherein each of the at least one first tunable switching element and the at least one second tunable switching element comprises a diode, a via, and a connective line electrically connecting the via and the diode, wherein the connective line comprises a first portion and a second portion, the first portion embedded in the upper conductive layer without being in direct physical contact with the upper conductive layer, the second portion being wider than the first portion and located outside the upper conductive layer, wherein the multi-throw switch is configured to direct propagation of an electromagnetic signal along the at least one first transmission path when the at least one first tunable switching element passes the electromagnetic signal and the at least one second tunable switching element blocks the electromagnetic signal, and wherein the multi-throw switch is configured to direct the propagation of the electromagnetic signal along the second transmission path when the at least one second tunable switching element passes the electromagnetic signal and the at least one first tunable switching element blocks the electromagnetic signal.

23. The arrangement according to claim 22, wherein each of the at least one first and second tunable switching elements is configured to pass the electromagnetic signal when the diode applies a load to the via, wherein each of the at least one first and second tunable switching elements is configured to block the electromagnetic signal when the diode applies a different load to the via, and wherein different states of each diode are controlled by a dc voltage.

24. The arrangement according to claim 22, wherein each of the at least one first and second tunable switching elements comprises at least two vias, two diodes and two conductive lines electrically connecting the vias and the diodes, wherein the conductive connection lines do not have the same length, and wherein each of the at least one first and second tunable switching elements is a reconfigurable EBG structure.

25. The arrangement according to claim 22, wherein each of the at least one first and second tunable switching elements comprises at least three vias, three diodes and three conductive lines electrically connecting the vias and the diodes, wherein a distance $d_1$ between a first conductive connection line and a second conductive connection line is different to a distance $d_2$ between the second conductive connection line and a third conductive connection line, and wherein each of the at least one first and second tunable switching elements is a reconfigurable EBG structure.

26. The arrangement according to claim 22, further comprising a third transmission path, wherein the multi-throw switch is configured to direct propagation of an electromagnetic signal along a third transmission path when at least one third switching element passes the electromagnetic signal and the at least one first and second tunable switching elements block the electromagnetic signal.

27. The arrangement according to claim 22, further comprising a coaxial cable connected to the multi-throw switch.

* * * * *